US007651345B2

(12) United States Patent
Tomioka et al.

(10) Patent No.: US 7,651,345 B2
(45) Date of Patent: Jan. 26, 2010

(54) ELECTRONIC APPARATUS IN WHICH AN CONDUCTIVE LAYER ON AN OUTER SURFACE OF A HOUSING IS ELECTRICALLY CONNECTED TO A CONDUCTIVE MEMBER IN THE HOUSING

(75) Inventors: Kentaro Tomioka, Sayama (JP); Tomomi Murayama, Nishitama-gun (JP); Noriyasu Kawamura, Kokubunji (JP); Toshiyuki Hirota, Hino (JP); Hironori Motoe, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/140,884

(22) Filed: Jun. 17, 2008

(65) Prior Publication Data

US 2008/0318447 A1 Dec. 25, 2008

(30) Foreign Application Priority Data

Jun. 19, 2007 (JP) ..... 2007-161469

(51) Int. Cl.
*H01R 4/66* (2006.01)

(52) U.S. Cl. ..... 439/97; 439/76.1; 439/927; 439/573; 439/801

(58) Field of Classification Search ..... 439/75, 439/76.1, 78, 573, 801, 92, 97, 927
See application file for complete search history.

(56) References Cited

U.S. PATENT DOCUMENTS

| | | | | |
|---|---|---|---|---|
| 3,810,069 | A * | 5/1974 | Jaconette, Jr. | 439/97 |
| 6,344,972 | B2 * | 2/2002 | Estieule et al. | 361/753 |
| 7,361,030 | B2 * | 4/2008 | Inoue et al. | 439/76.1 |
| 2002/0127909 | A1 * | 9/2002 | Pradier et al. | 439/573 |

FOREIGN PATENT DOCUMENTS

| | | |
|---|---|---|
| JP | 2001244715 | 9/2001 |
| JP | 200369325 | 3/2003 |
| JP | 2005190064 | 7/2005 |

* cited by examiner

*Primary Examiner*—Tho D Ta
(74) *Attorney, Agent, or Firm*—Blakely, Sokoloff, Taylor & Zafman LLP

(57) ABSTRACT

According to one embodiment, an electronic apparatus includes a conductive layer provided on an outer surface of a housing, a conductive member provided inside the housing, and a connecting component attached to the housing. The housing is provided with a through hole which causes the inside of the housing to communicate with the outside. The connecting component has conductivity, and is provided with a major diameter section and a minor diameter section. The major diameter section is formed larger than the through hole, is opposed to the conductive layer from outside the housing, and is electrically connected to the conductive layer. The minor diameter section is formed smaller than the through hole, is inserted in the through hole to reach the inside of the housing, and is electrically connected to the conductive member.

17 Claims, 11 Drawing Sheets

ELECTRONIC APPARATUS IN WHICH AN CONDUCTIVE LAYER ON AN OUTER SURFACE OF A HOUSING IS ELECTRICALLY CONNECTED TO A CONDUCTIVE MEMBER IN THE HOUSING

CROSS-REFERENCE TO RELATED APPLICATIONS

This application is based upon and claims the benefit of priority from Japanese Patent Application No. 2007-161469, filed Jun. 19, 2007, the entire contents of which are incorporated herein by reference.

BACKGROUND

1. Field

One embodiment of the invention relates to an electronic apparatus provided with a conductive layer on an outer surface of a housing.

2. Description of the Related Art

There are various types of electronic apparatuses. For example, some of the electronic apparatuses are provided with a conductive layer on an outer surface of a housing. In Jpn. Pat. Appln. KOKAI Publication No. 2001-244715, disclosed is a portable wireless apparatus in which a radiation conductor serving as a part of an antenna is provided on an outer surface of a housing. This portable wireless apparatus is provided with a capacity plate held on a feeder line in the housing. The radiation conductor and the capacity plate are arranged such that they partly overlap each other, and a wireless circuit board and the radiation conductor are capacitively coupled to each other. As a result of this, supply of power to the radiation conductor is performed through the capacity between the capacity plate and the radiation conductor.

When a conductive layer is provided on an outer surface of a housing, how to secure electrical connection between the conductive layer and a conductive member provided inside the housing is one of the subject matters. With the capacitive coupling as in the above-mentioned portable wireless apparatus, although electrical connection can be secured, electrical loss is caused at the connection section. Accordingly, it can be said that there is yet room for further improvement in the connection structure of the above portable wireless apparatus.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, an electronic apparatus is provided with a housing; a conductive layer provided on an outer surface of the housing; a conductive member provided inside the housing; and a connecting component attached to the housing. The housing is provided with a through hole which causes the inside of the housing to communicate with the outside. The connecting component has conductivity, and is provided with a major diameter section and a minor diameter section. The major diameter section is formed larger than the through hole, is opposed to the conductive layer from outside the housing, and is electrically connected to the conductive layer. The minor diameter section is formed smaller than the through hole, is inserted in the through hole to reach the inside of the housing, and is electrically connected to the conductive member.

Figure 1:
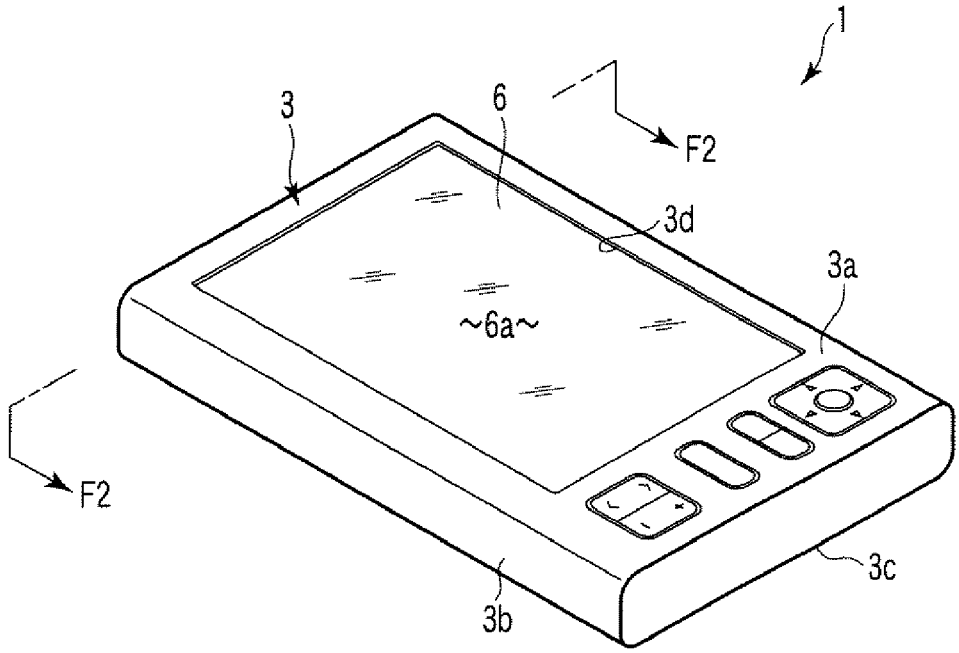
FIG. 1 is an exemplary perspective view of an electronic apparatus according to a first embodiment of the present invention.
Figure 2:
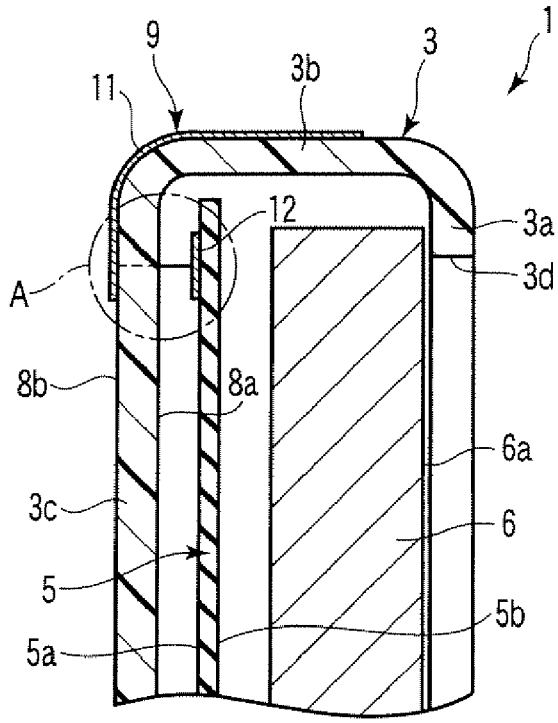
FIG. 2 is an exemplary cross-sectional view of the electronic apparatus shown in FIG. 1 taken along line F2-F2.
Figure 3:
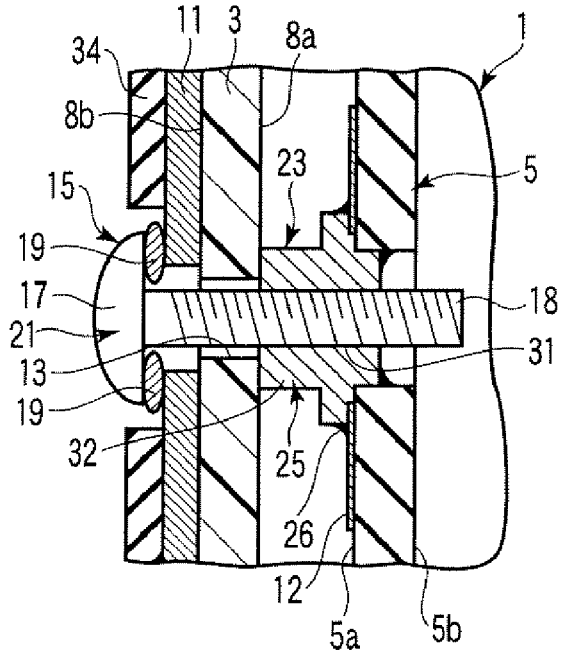
FIG. 3 is an exemplary cross-sectional view of a region of the electronic apparatus shown in FIG. 2 encircled by a one dotted chain line A.

First, first to fourth embodiments of the present invention will be described below on the basis of drawings in which the embodiments are applied to a personal digital assistance (i.e., portable information terminal). FIGS. 1 to 3 disclose an electronic apparatus 1 according to a first embodiment of the present invention. An example of the electronic apparatus 1 is a small-sized personal digital assistance in which a main body of the apparatus is provided with a display section. As shown in FIG. 1, the electronic apparatus 1 is provided with a housing 3 formed into a box-like shape. The housing 3 includes an upper wall 3*a*, a peripheral wall 3*b*, and a lower wall 3*c*.

As shown in FIG. 2, a printed circuit board 5, and a display device 6 are provided inside the housing 3. The printed circuit board 5 is an example of a conductive member mentioned in the present invention. The display device 6 is provided with a display screen 6*a*. An example of the display device 6 is a liquid crystal display. A large opening 3*d* that exposes the display screen 6*a* to the outside of the housing 3 is provided in the upper wall 3*a* of the housing 3.

As shown in FIG. 2, on an outer surface 8*b* of the housing 3, for example, a conductive layer 11 which serves as an antenna element of an antenna 9 is provided. This conductive layer 11 is formed on the surface 8*b* by in-mold fabrication such as IMR and IMF, metal vapor deposition, plating, or sputtering. A specific example of the conductive layer 11 is a vapor-deposited film of aluminum. Further, the antenna 9 includes an antenna ground (not shown).

Incidentally, the conductive layer to which the present invention can be applied is not limited to the conductive layer 11 serving as an antenna element. The present invention may also be applied to, for examples a conductive layer which serves as an antenna ground, and can be applied to a conductive layer provided for other various purposes. Further, the method of forming the conductive layer is not limited to the method described above.

On the other hand, the printed circuit board 5 includes a first surface 5*a* opposed to an inner surface 8*a* of the housing 3, and a second surface 5*b* on the opposite side of the first surface 5*a*. On the first surface 5*a*, a wiring pattern 12 to be electrically connected to the conductive layer 11 is provided. The wiring pattern 12 is a signal line when the conductive layer 11 is used as, for example, an antenna element, and is a ground when the conductive layer 11 is used as an antenna ground. FIG. 2 is a view schematically showing a connection structure for connecting the conductive layer 11 and the wiring pattern 12 of the printed circuit board 5 to each other.

Next, the connection structure for connecting the conductive layer 11 and the printed circuit board 5 to each other will be described below in detail with reference to FIG. 3. As shown in FIG. 3, the housing 3 is provided with a through hole 13 opened to the inside of the housing 3. That is, the through hole 13 causes the inside of the housing 3 to communicate with the outside of the housing 3. The through hole 13 is opened in, for example, a region adjacent to the conductive layer 11, or a region in which the conductive layer 11 is provided.

The electronic apparatus 1 is provided with a connecting component 15 attached to the housing 3 and electrically connecting the conductive layer 11 to the printed circuit board 5. The connecting component 15 has conductivity. Here, "a component (or member) has conductivity" mentioned in the invention includes, in addition to a case where the entire part of the component (or of the member) has conductivity, a case where only a part of the component (or of the member) has conductivity.

As shown in FIG. 3, the connecting component 15 includes a major diameter section 17 and a minor diameter section 18. The major diameter section 17 is formed larger than a diameter of the through hole 13, and is opposed to the conductive layer 11 from the outside of the housing 3. Between the major diameter section 17 and the conductive layer 11, for example, an electrical connection member 19 is interposed. The major diameter section 17 is electrically connected to the conductive layer 11 through the electrical connection member 19.

Specific examples of the electrical connection member 19 are a conductive adhesive, a conductive paste solder, brazing filler metal, a spring, an anisotropic conductive film (ACF), and the like. When the electrical connection member 19 is interposed between the major diameter section 17 and the conductive layer 11, electrical connection between the major diameter section 17 and the conductive layer 11 is further strengthened. Incidentally, the major diameter section 17 may be directly brought into contact with the conductive layer 11 to thereby be connected to the conductive layer 11 without the interposition of the electrical connection member 19.

On the other hand, as shown in FIG. 3, the minor diameter section 18 of the connecting component 15 is formed smaller than the diameter of the through hole 13, and is inserted in the through hole 13 to reach the inside of the housing 3. The minor diameter section 18 is formed integral with, for example, the major diameter section 17. The connecting component 15 according to this embodiment is, for example, a screw 21 made of metal. The entirety of the screw 21 has conductivity, and is also provided with a screw head which is the major diameter section 17 and a screw shaft which is the minor diameter section 18. An external thread is formed on the minor diameter section 18. As shown in FIG. 3, the connecting component 15 is fixed to the housing from the outside.

A receiving member 23 is provided inside the housing 3, and is fixed to the first surface 5*a* of the printed circuit board 5. The minor diameter section 18 of the connecting component 15 inserted in the housing 3 is engaged with the receiving member 23. Further, the receiving member 23 is formed larger than the diameter of the through hole 13. The receiving member 23 has, for example, conductivity, and is electrically connected to the printed circuit board 5.

This allows the minor diameter section 18 of the connecting component 15 engaged with the receiving member 23 to be electrically connected to the printed circuit board 5 through the receiving member 23. Furthermore, the conductive layer 11 is electrically connected to the wiring pattern 12 of the printed circuit board 5 through the connecting component 15 and the receiving member 23. This enables the conductive layer 11 to be fed with electricity.

More specifically, the receiving member 23 according to this embodiment is a stud 25 fixed to the printed circuit board 5. The stud 25 is arranged in a region on the first surface 5*a* of the printed circuit board 5 opposed to the through hole 13. The stud 25 is made of, for example, metal, or a conductive layer is provided on the surface thereof by, for example, plating, and the stud 25 has conductivity. The stud 25 is electrically connected to the wiring pattern 12 through a conductive member 26 such as solder.

The stud 25 includes a threaded hole 31 in which a female screw is formed. The minor diameter section 18 of the screw 21 is engaged with the threaded hole 31. The stud 25 is formed larger than the through hole 13, and hence the screw 21 engaged with the stud 25 becomes unable to be pulled out of the through hole 13. Further, the stud 25 includes a part 32 interposed between the printed circuit board 5 and an inner surface 8*a* of the housing 3. That is, an end of the stud 25 is in contact with the inner surface 8*a* of the housing 3.

Incidentally, in this embodiment, an insulating layer 34 is provided on the outer side of the conductive layer 11 on the outer surface 8*b* of the housing 3. This insulating layer 34 is provided by, for example, in-mold fabrication. The insulating layer 34 is provided to remain clear of a region around the through hole 13, and the conductive layer 11 is exposed to the outside around the through hole 13. Incidentally, the insulating layer 34 may not be provided.

According to the electronic apparatus 1 configured as described above, it is possible to electrically connect the conductive member (i.e., printed circuit board 5) provided in the housing 3 to the conductive layer 11 provided on the outer surface 8*b* of the housing 3 at an arbitrary position, and restrict electrical loss caused at the connection section between the conductive member and the conductive layer 11 to a low level.

That is, the connecting component 15 is provided with the major diameter section 17 opposed to the conductive layer 11 from the outside of the housing 3, whereby it is possible to electrically and securely connect the connecting component 15 to the conductive layer 11 provided on the outer surface 8*b* of the housing 3. Furthermore, the through hole 13 is provided in the housing 3, and a part of the connecting component 15 is provided with the minor diameter section 18 to be inserted in the through hole 13 to reach the inside of the housing 3, whereby it is possible to electrically connect the conductive layer 11 to the printed circuit board 5 in the housing 3.

Such a connection structure can be appropriately provided at an arbitrary position almost without being restricted by the arrangement or shape of the other member in the housing 3. When the conductive layer 11 provided on the outer surface 8*b* of the housing 3 can be electrically connected to the printed circuit board 5 provided in the housing 3 at an arbitrary position, the freedom of part mounting is enhanced.

Further, the connecting component 15 extends from the outside of the housing 3 to the inside thereof through the through hole 13, whereby the conductive layer 11 and the printed circuit board 5 are directly connected to each other through a plurality of members having conductivity. That is, an electrical connection passage formed by mechanical (that is, structural) connection of a plurality of members having conductivity is constructed between the conductive layer 11 and the printed circuit board 5. This makes it possible to restrict electrical loss to a lower level as compared with, for example, the case of the connection structure in which a space such as that of capacitive coupling is present.

When the electrical loss can be restricted, for example, when the conductive layer 11 is used as an antenna element, deterioration of the antenna performance can be restricted. That is, according to such a structure, it is possible to realize a feeding structure in which power is fed from the printed circuit board 5 in the housing 3 to the antenna element on the outer surface 8*b* of the housing 3, and which hardly deteriorates the antenna characteristic.

As another connection structure, connecting the conductive layer provided on the outer surface 8*b* of the housing 3 and the conductive member in the housing 3 to each other through a coaxial cable or a feeder line drawn circuitously through an opening of the housing 3 which exists for another purpose can be considered. The path length of the coaxial cable or the feeder line becomes relatively long due to the circuitous route. On the other hand, when the through hole 13 is provided in the housing 3, and the connecting component 15 which extends from the outside of the housing to the inside thereof through the through hole 13 is provided, the path length of the electrical connection passage can be made short. This makes it possible to restrict the electrical loss to a lower level than the case where the circuitously drawn coaxial cable or feeder line is used.

When the receiving member 23 has a larger shape than the through hole 13 of the housing 3, and a part of the connecting component 15 is engaged with the receiving member 23, the connecting component 15 becomes unable to be pulled out of the through hole 13. Furthermore, when the receiving member 23 has conductivity and is electrically connected to the printed circuit board 5, it becomes unnecessary to separately provide another connecting component for electrically connecting the connecting component 15 and the printed circuit board 5 to each other, and hence it is possible to obtain an electronic apparatus 1 advantageous to size reduction and cost reduction.

Further, the connecting component 15 and the receiving member 23 are provided, whereby it is possible to electrically connect the conductive layer 11 provided on the outer surface 8*b* of the housing 3 and the printed circuit board 5 to each other without the interposition of various connecting components such as a coaxial cable. When the conductive layer 11 and the printed circuit board 5 are electrically connected to each other by means of the connecting component 15 and the receiving member 23, it is possible to make further compact the connection structure for connecting the conductive layer 11 and the printed circuit board 5 to each other as compared with the case where the coaxial cable or the like is used. That is, an electronic apparatus 1 advantageous to size reduction can be obtained.

When the connecting component 15 is the screw 21, the conductive member is the printed circuit board 5, and the receiving member 23 is the stud 25 fixed to the printed circuit board 5, the conductive layer 11 provided on the outer surface 8*b* of the housing 3 is electrically connected to the printed circuit board 5 directly through the screw 21 and the stud 25, and hence it can be said that the connection structure can be realized by a simple structure. This contributes to size reduction and cost reduction of the electronic apparatus 1.

When the stud 25 includes a part 32 interposed between the inner surface 8*a* of the housing 3 and the printed circuit board 5 the position of the printed circuit board 5 is fixed by engaging the screw 21 with the stud 25. That is, according to such a configuration, the connecting component 15 can function as a fixing member of the printed circuit board 5.

Next, an electronic apparatus 1 according to a second embodiment of the present invention will be described below with reference to FIG. 4. Incidentally, a configuration having functions identical with or similar to those of the electronic apparatus 1 according to the first embodiment is denoted by the same reference symbol, and a description thereof is omitted. The second embodiment differs from the first embodiment in the shape of a stud, and the fundamental configuration of the electronic apparatus is identical with the first embodiment.

Figure 4:
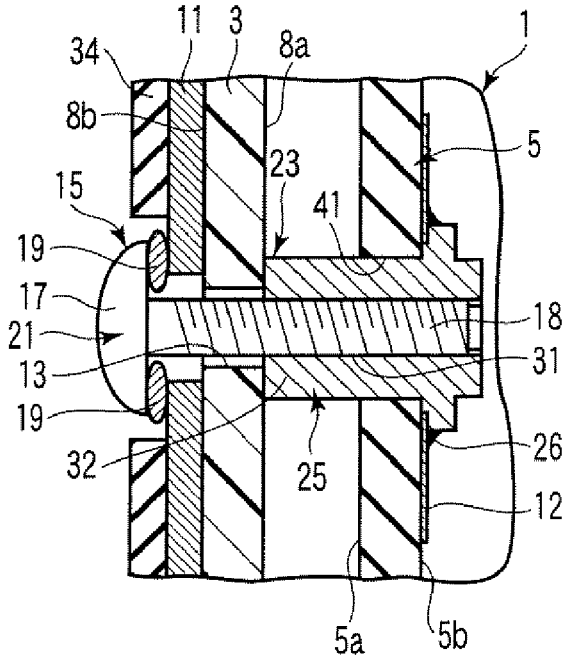
FIG. 4 is an exemplary cross-sectional view of an electronic apparatus according to a second embodiment of the present invention.

As shown in FIG. 4, a printed circuit board 5 includes a wiring pattern 12 provided on a second surface 5*b* thereof. Furthermore, the printed circuit board 5 is provided with a through hole 41 penetrating the circuit board 5 from a first surface 5*a* to the second surface 5*b*. A stud 25 serving as a receiving member 23 is attached to the through hole 41, penetrates the printed circuit board 5, and is exposed on the second surface 5*b*.

The stud 25 exposed on the second surface 5*b* is electrically connected to the wiring pattern 12 through a conductive member 26 such as solder. As a result of this, a conductive layer 11 is electrically connected to the wiring pattern 12 of the printed circuit board 5 through a screw 21 serving as a connecting component 15.

According to the electronic apparatus 1 configured as described above, it is possible, as the first embodiment, to electrically connect the conductive member provided in the housing 3 to the conductive layer 11 provided on the outer surface 8*b* of the housing 3 at an arbitrary position, and restrict electrical loss caused at the connection section between the conductive member and conductive layer 11 to a low level.

The first embodiment and the second embodiment differ from each other only in the shape of the stud 25, and are identical with each other in the other configuration. That is, it is possible to appropriately and selectively employ the connection structure according to the first embodiment or the connection structure according to the second embodiment merely by changing the type of the stud 25 to be employed. When it is possible to appropriately and selectively employ the connection structure according to the first embodiment or the connection structure according to the second embodiment as the electrical connection structure between the conductive layer 11 and the printed circuit board 5 in the housing 3, it is possible to obtain an electronic apparatus 1 in which the freedom of electrical connection to the wiring patterns 12 on both the surfaces of the printed circuit board 5 is enhanced, and stress inside the electronic apparatus such as stress on a soldered part or stress due to heat or a structural factor can be effectively coped with.

Next, an electronic apparatus 1 according to a third embodiment of the present invention will be described below with reference to FIG. 5. Incidentally, a configuration having functions identical with or similar to those of the electronic apparatus 1 according to the first embodiment is denoted by the same reference symbol, and a description thereof is omitted. The third embodiment differs from the first embodiment in being provided with a spacer, and the fundamental configuration of the electronic apparatus is identical with the first embodiment.

Figure 5:
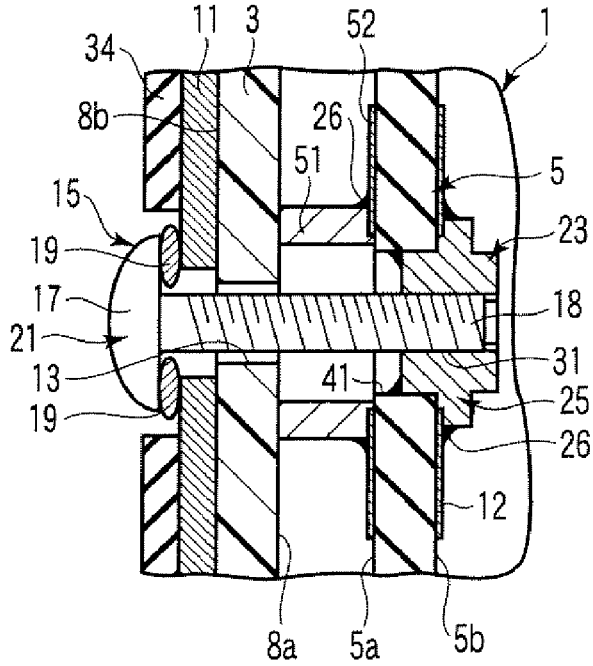
FIG. 5 is an exemplary cross-sectional view of an electronic apparatus according to a third embodiment of the present invention.

As shown in FIG. 5, a stud 25 serving as a receiving member 23 is fixed to a second surface 5*b* of a printed circuit board 5. The printed circuit board 5 is provided with a through hole 41 in a region thereof opposed to a through hole 13 of a housing 3. A part of the stud 25 is inserted in the through hole 41. A threaded hole 31 of the stud 25 is opposed to the through hole 13 of the housing 3 through the through hole 41.

A minor diameter section 18 of a screw 21 serving as a connecting component 15 is inserted in the housing 3, and is engaged with the threaded hole 31 of the stud 25 through the through hole 41 of the printed circuit board 5. A conductive layer 11 is electrically connected to a wiring pattern 12 of the printed circuit board 5 through the screw 21 and the stud 25.

On the other hand, as shown in FIG. 5, a spacer 51 is provided between an inner surface 8*a* of the housing 3 and the printed circuit board 5. The spacer 51 is interposed between the inner surface 8*a* of the housing 3 and a first surface 5*a* of the printed circuit board 5, and maintains a gap between the inner surface 8*a* and the first surface 5*a*. An example of the spacer 51 is one made of, for example, metal, or on a surface thereof, a conductive layer is formed by, for example, plating or the like, and is provided with conductivity.

The printed circuit board 5 is provided with another wiring pattern 52 on, for example, the first surface 5*a*.

The wiring pattern 52 is a ground. An example of the spacer 51 is one formed into a tubular shape, and encircles a circumference of the minor diameter section 18 of the connecting component 15. The spacer 51 is electrically connected to the wiring pattern 52, and is at the ground potential.

According to the electronic apparatus 1 configured as described above, it is possible, as the first embodiment, to electrically connect the conductive member provided in the housing 3 to the conductive layer 11 provided on the outer surface 8*b* of the housing 3 at an arbitrary position, and restrict electrical loss caused at the connection section between the conductive member and the conductive layer 11 to a low level.

By providing the spacer 51, it is possible to employ the printed circuit board 5 which is standardized so that it can be employed in a plurality of electronic apparatuses. That is, when the gap between the inner surface 8*a* of the housing 3 and the printed circuit board 5 differs depending on the type of the electronic apparatus to which the printed circuit board 5 is applied, it is possible to cope with the difference by changing a height of the spacer 51.

Furthermore, when the stud 25 is utilized as a signal line, if the spacer 51 is electrically connected to the ground, this connection section constitutes a shielding structure, and hence electrical loss caused between the printed circuit board 5 and the conductive layer 11 can be further restricted. Further, such a shielding structure is constituted, whereby it is possible to obtain an electronic apparatus in which an undesired radio wave is not radiated inside the housing 3, and which is advantageous from the viewpoint of EMI. Incidentally, it is not always necessary for the stud 25 to be electrically connected to the ground.

Figure 6:
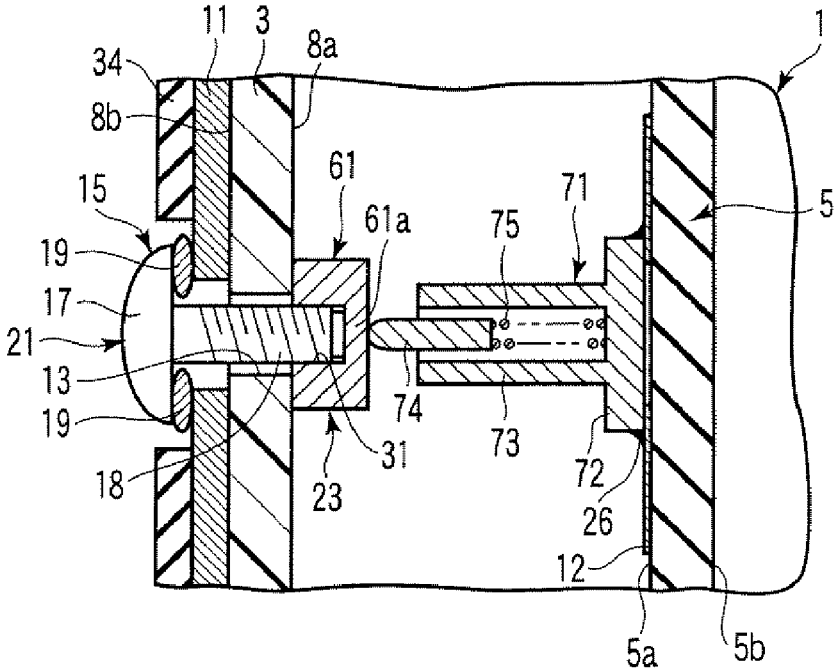
FIG. 6 is an exemplary cross-sectional view of an electronic apparatus according to a fourth embodiment of the present invention.

Next, an electronic apparatus 1 according to a fourth embodiment of the present invention will be described below with reference to FIG. 6. Incidentally, a configuration having functions identical with or similar to those of the electronic apparatus 1 according to the first embodiment is denoted by the same reference symbol, and a description thereof is omitted. The fourth embodiment differs from the first embodiment in being provided with an elastic connecting component, and the fundamental configuration of the electronic apparatus is identical with the first embodiment.

A connecting component 15 according to this embodiment is a screw 21, and a receiving member 23 is a bottomed nut 61. The bottomed nut 61 is provided inside the housing 3, and is provided with a threaded hole 31 opposed to a through hole 13 of a housing 3. A minor diameter section 18 of a screw 21 inserted in the housing 3 is engaged with the bottomed nut 61. The bottomed nut 61 is formed larger than a diameter of the through hole 13. Accordingly, the screw 21 engaged with the bottomed nut 61 becomes unable to be pulled out of the through hole 13. The bottomed nut 61 is made of, for example, metal, and has conductivity. The bottomed nut 61 includes a bottom section 61*a* opposed to a printed circuit board 5.

On the other hand, in a region of the printed circuit board 5 (i.e., conductive member) opposed to the bottomed nut 61, an elastic connecting component 71 is provided. The elastic connecting component 71 has conductivity, and is interposed between the bottom section 61*a* of the bottomed nut 61 and the printed circuit board 5. At least a part of the elastic connecting component 71 has elasticity. An example of the elastic connecting component 71 is a POGO pin type connector which has a characteristic that the component 71 is deformed by a load.

More specifically, an example of the elastic connecting component 71 is provided with a proximal end section 72 fixed to the printed circuit board 5, a tubular section 73 rising from the proximal end section 72 toward the bottomed nut 61, a contact pin 74 which is encased in the tubular section 73 so that it can be freely moved forward and backward, and an elastic member 75 provided between the contact pin 74 and the proximal end section 72. The elastic member 75 is an example of an elastic part mentioned in the present invention, and is, for example, a spring. The elastic connecting component 71 interposed between the bottomed nut 61 and the printed circuit board 5 is compressed at the elastic member 75 thereof, and presses the contact pin 74 against the bottomed nut 61. As a result of this, the contact pin 74 is kept in contact with the bottomed nut 61, and the elastic connecting component 71 is electrically connected to the bottomed nut 61 in a stable state.

The elastic connecting component 71 is electrically connected to a wiring pattern 12 of the printed circuit board 5. The minor diameter section 18 of the screw 21 engaged with the bottomed nut 61 is electrically connected to the printed circuit board 5 through the bottomed nut 61 and the elastic connecting component 71. As a result, the conductive layer 11 is electrically connected to the wiring pattern 12 through the screw 21, the bottomed nut 61, and the elastic connecting component 71.

According to the electronic apparatus 1 configured as described above, it is possible, as the first embodiment, to electrically connect the conductive member provided in the housing 3 to the conductive layer 11 provided on the outer surface 8*b* of the housing 3 at an arbitrary position, and restrict electrical loss caused at the connection section between the conductive member and conductive layer 11 to a low level.

When the elastic connecting component 71 is provided, the structure of the connection section can easily follow, for example, the parts tolerance or the like of the housing 3 and the printed circuit board 5, thereby making it possible to alleviate the stress on the surrounding parts. Incidentally, in this embodiment, although the elastic connecting component 71 includes the elastic member 75 at a part thereof, the elastic connecting component may be replaced with a connecting component the entirety of which is constituted of an elastic body.

Next, fifth to seventh embodiments of the present invention will be described below on the basis of drawings in which the embodiments are applied to portable computers. First, an electronic apparatus 81 according to a fifth embodiment of the present invention will be described below with reference to FIGS. 7 to 12. Incidentally, a configuration having functions identical with or similar to those of the electronic apparatus 1 according to the first embodiment is denoted by the same reference symbol, and a description thereof is omitted.

Figure 7:
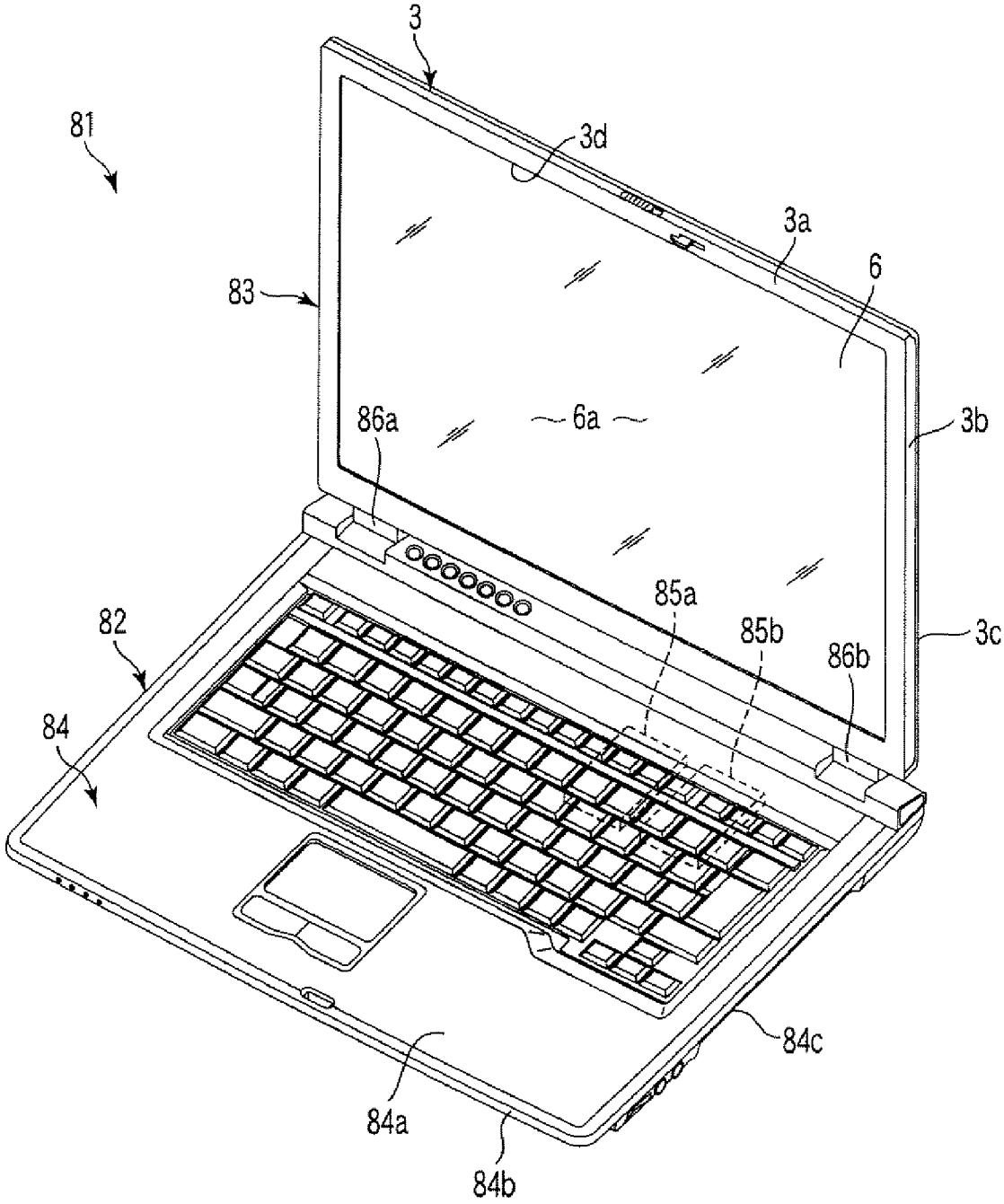
FIG. 7 is an exemplary cross-sectional view of an electronic apparatus according to a fifth embodiment of the present invention.

FIG. 7 discloses the entirety of the electronic apparatus 81 according to this embodiment. An example of the electronic apparatus 81 is a portable computer. The electronic apparatus 81 is provided with a main unit 82, and a display unit 83. The main unit 82 is provided with a main unit housing 84 formed into a box-like shape. The main unit housing 84 includes an upper wall 84*a*, a peripheral wall 84*b*, and a lower wall 84*c*. A main circuit board (not shown) and, for example, a plurality of wireless modules 85*a* and 85*b* are provided in the main unit housing 84.

The display unit 83 is provided with a display unit housing 3 (hereinafter abbreviated as a housing 3), and a display device 6 contained in this housing 3. One end of the display unit 83 is supported on a rear end of the main unit housing 84 through a pair of hinge portions 86*a* and 86*b*. As a result of this, the display unit 83 can be turned between a closed position in which the display unit 83 is laid down to cover the upper wall 84*a* from above, and an opened position in which the display unit 83 rises to expose the upper wall 84*a*.

Figure 8:
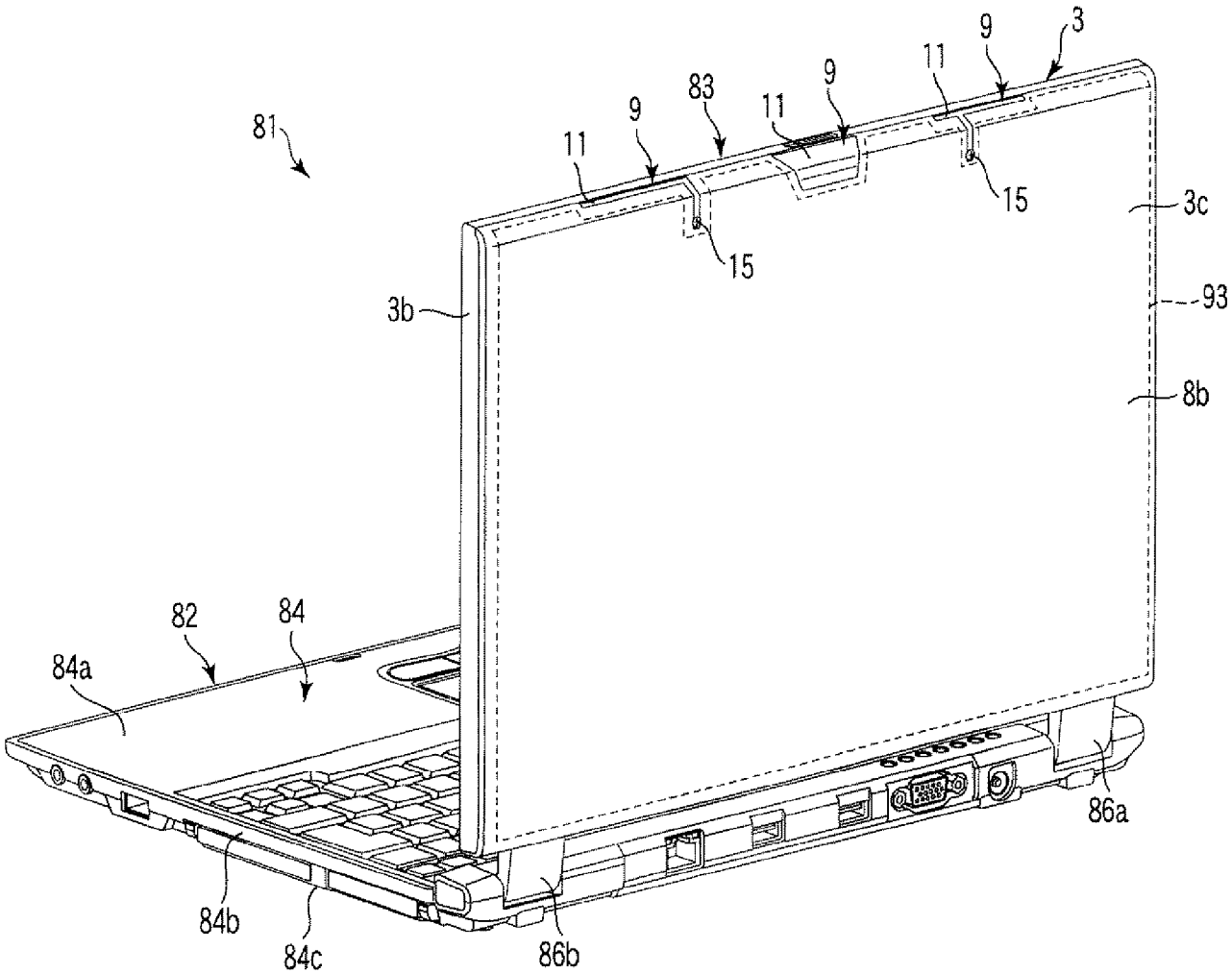
FIG. 8 is an exemplary perspective view of the electronic apparatus shown in FIG. 7 viewed from another angle.

As shown in FIG. 8, the electronic apparatus 81 is provided with, for example, three antennas 9. On an outer surface 8*b* of the housing 3, a first conductive layer 11 which serves as an antenna element of the antenna 9 is provided. This first conductive layer 11 is an example of a conductive layer mentioned in the present invention. On the other hand, a second conductive layer 93 is provided on an inner surface 8*a* of the housing 3. The second conductive layer 93 is provided as a part of measures for EMI, and serves as a shield for restraining undesired electromagnetic radiation from leaking from inside the housing 3 to the outside, and restraining undesired electromagnetic radiation from entering the housing 3 from outside. This second conductive layer 93 is formed by, for example, providing the inner surface 8*a* of the housing with an electrically conductive coating layer, or plating the surface 8*a*, or sticking metallic foil such as an aluminum sheet on the surface 8*a*.

Figure 9:
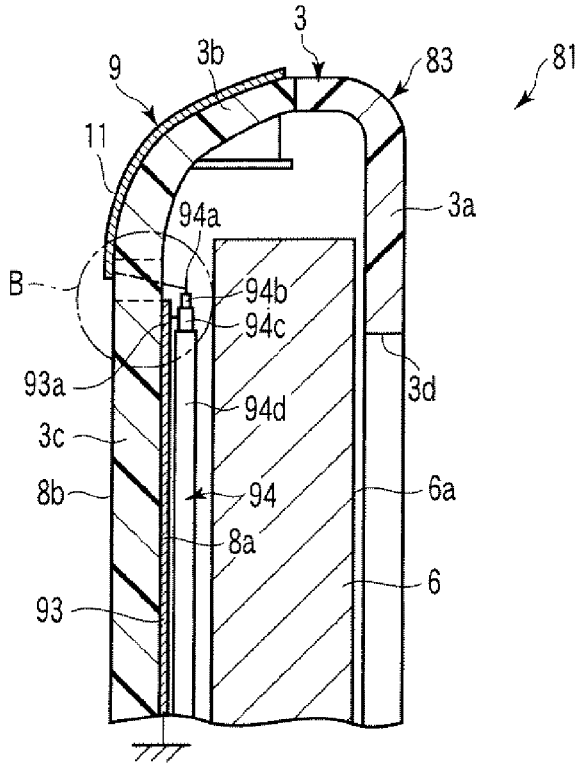
FIG. 9 is an exemplary cross-sectional view of the electronic apparatus shown in FIG. 7.

The antenna 9 uses this second conductive layer 93 as an antenna ground. More specifically, in the housing 3, a coaxial cable 94 connected to the wireless module 85*a* extends. A signal section 94*a* of the coaxial cable 94 is an example of a conductive member mentioned in the present invention. FIG. 9 schematically shows a connection structure for connecting the coaxial cable 94 and the antenna 9 to each other. As shown in FIG. 9, the coaxial cable 94 has a quadruplex structure, and is provided with a signal section 94*a*, a first insulation section 94*b* wrapped around the signal section 94*a*, a ground section 94*c* wrapped around the first insulation section 94*b*, and a second insulation section 94*d* wrapped around the ground section 94*c*.

The coaxial cable 94 extends from the wireless module 85*a* to an end part 93*a* of the second conductive layer 93 in a state where the cable 94 maintains a constant impedance value, and the ground section 94*c* and the signal section 94*a* are exposed to the outside of the coaxial cable 94 at a position in the vicinity of the border between the second conductive layer 93 and the first conductive layer 11. The exposed signal section 94*a* is electrically connected to the first conductive layer 11. Further, the ground section 94*c* is electrically connected to the second conductive layer 93.

Figure 10:
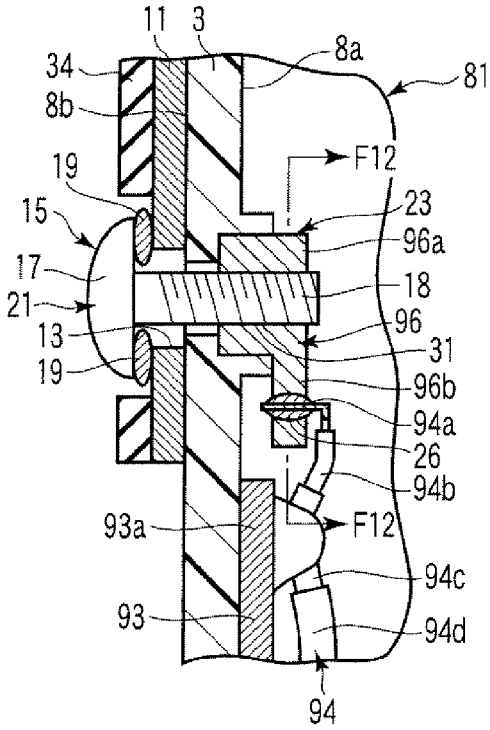
FIG. 10 is an exemplary cross-sectional view of a region of the electronic apparatus shown in FIG. 9 encircled by a one dotted chain line B.
Figure 11:
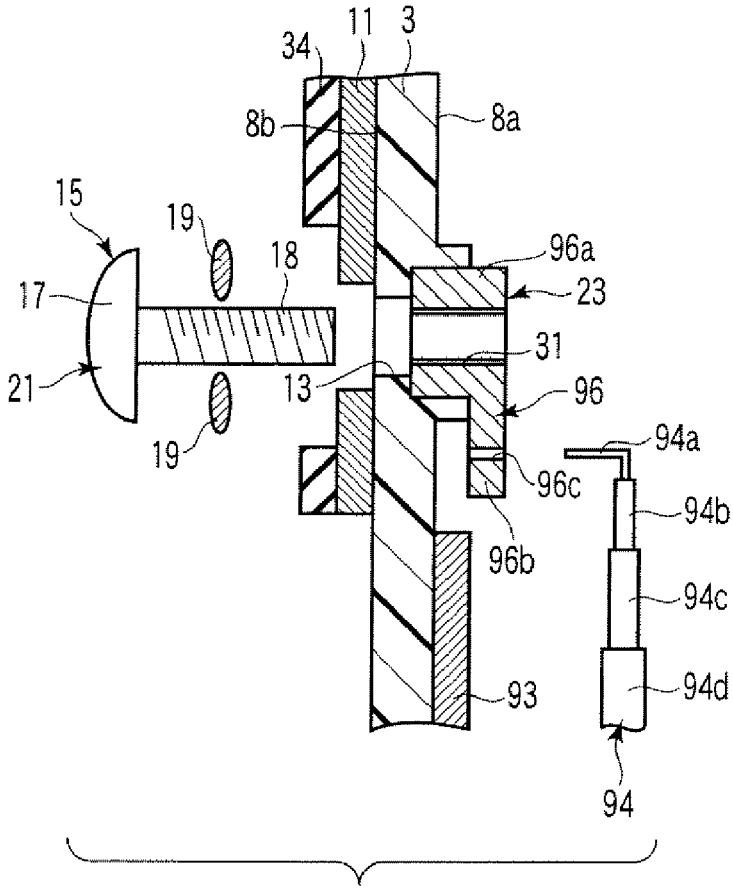
FIG. 11 is an exemplary cross-sectional view showing a connection structure shown in FIG. 10 in an exploded state.

Next, the connection structure for connecting the coaxial cable 94 and the antenna 9 to each other will be described below in detail with reference to FIGS. 10 to 12. FIG. 10 is a view showing, in detail, the connection structure for connecting the coaxial cable 94 and the antenna 9 to each other. FIG. 11 is a view showing the connection structure in an exploded state.

As shown in FIGS. 10 and 11, a housing 3 is provided with a through hole 13. The electronic apparatus 81 is provided with a connecting component 15 attached to the housing 3. The connecting component 15 is a screw 21 which has conductivity, and is provided with a major diameter section 17 and a minor diameter section 18 as in the first embodiment. An example of a receiving member 23 according to this embodiment is a nut. A more specific example of the receiving member 23 is an insert nut 96 which is arranged inside the housing 3 and is fixed to the inner surface 8*a* of the housing 3.

The insert nut 96 is provided with a threaded hole 31 opposed to the through hole 13 of the housing 3. A minor diameter section 18 of a screw 21 inserted in the housing 3 is engaged with the insert nut 96. The insert nut 96 is formed larger than the through hole 13. Thus, the screw 21 engaged with the insert nut 96 becomes unable to be pulled out of the through hole 13.

The insert nut 96 is made of, for example, metal, and has conductivity. As shown in FIG. 12, the insert nut 96 includes a main body section 96*a* and an overhang section 96*b* extending from the main body section 96*a*. The main body section 96*a* and the overhang section 96*b* are electrically connected to each other. A threaded hole 31 is provided in the main body section 96*a*. A through hole 96*c* is provided in the overhang section 96*b*. The signal section 94*a* of the coaxial cable 94 is inserted in the through hole 96*c*, and is fixed therein by a conductive member 26 such as solder. As a result of this, the insert nut 96 is electrically connected to the signal section 94*a* of the coaxial cable 94.

Accordingly, the screw 21 engaged with the insert nut 96 is electrically connected to the signal section 94*a* of the coaxial cable 94 through the insert nut 96. More specifically, the first conductive layer 11 is electrically connected to the signal section 94*a* through the screw 21 and the insert nut 96.

Figure 12:
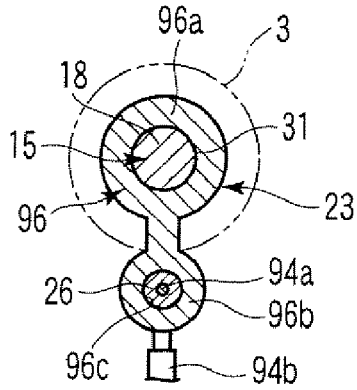
FIG. 12 is an exemplary cross-sectional view of the electronic apparatus shown in FIG. 10 taken along line F12-F12.

On the other hand, as shown in FIG. 12, the ground section 94*c* of the coaxial cable 94 is fixed to the second conductive layer 93 by a conductive member 26 in the housing 3. As a result of this, the second conductive layer 93 is electrically connected to the ground section 94*c*, and functions as an antenna ground.

According to the electronic apparatus 1 configured as described above, it is possible, as the first embodiment, to electrically connect the conductive member (i.e., the signal section 94*a* of the coaxial cable) provided in the housing 3 to the conductive layer 11 provided on the outer surface 8*b* of the housing 3 at an arbitrary position, and restrict electrical loss caused at the connection section between the conductive member and the conductive layer 11 to a low level.

That is, the connecting component 15 is provided with the major diameter section 17, whereby it is possible to electrically connect the connecting component 15 securely to the conductive layer 11 provided on the outer surface 8*b* of the housing 3. Furthermore, the through hole 13 is provided in the housing 3, and a part of the connecting component 15 is provided with the minor diameter section 18 to be inserted in the through hole 13 to reach the inside of the housing 3, whereby it is possible to electrically connect the conductive layer 11 to the coaxial cable 94 inside the housing 3.

Furthermore, the connecting component 15 extends from the outside of the housing 3 to the inside of the housing 3 through the through hole 13, whereby the conductive layer 11 and the coaxial cable 94 are directly connected to each other through a plurality of members having conductivity. That is, an electrical connection passage formed by mechanical connection of a plurality of members having conductivity is constructed between the conductive layer 11 and the coaxial cable 94. This makes it possible to restrict electrical loss to a lower level as compared with, for example, the case of the connection structure in which a space such as that of capacitive coupling is present.

The through hole 13 is provided in the housing 3, and the connecting component 15 extending from the outside of the housing 3 to the inside of the housing 3 through the through hole 13 is provided, whereby it is possible to shorten the length of the coaxial cable 94. This makes it possible to restrict the electrical loss than the case where the circuitously drawn coaxial cable or feeder line is used. From another viewpoint, the feeder line is formed by the coaxial cable 94 provided with a shielding structure extending up to the vicinity of the border between the first conductive layer 11 serving as the antenna element and the second conductive layer 12 serving as the antenna ground, and hence it is possible to restrict the electrical loss than the case where an exposed feeder line is provided on the inner or outer surfaces 8*a* and 8*b* of the housing.

When the connecting component is the screw 21, and the receiving member 23 is the insert nut 96 fixed to the housing 3, it is possible to electrically connect the first conductive layer 11 to the signal section 94*a* of the coaxial cable 94 by a relatively simple structure.

Figure 16:
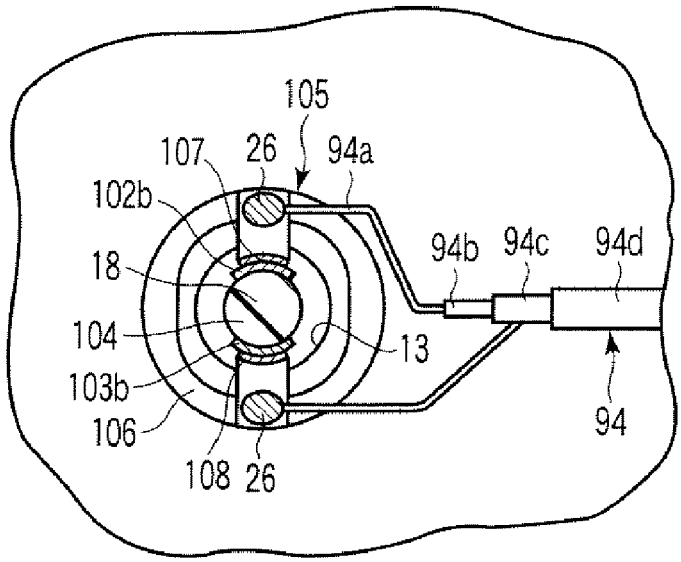
FIG. 16 is an exemplary cross-sectional view of the electronic apparatus shown in FIG. 14 taken along line F16-F16.

Next, an electronic apparatus 81 according to a sixth embodiment of the present invention will be described below with reference to FIGS. 13 and 16. Incidentally, a configuration having functions identical with or similar to those of the electronic apparatuses according to the first and fifth embodiments is denoted by the same reference symbol, and a description thereof is omitted. The sixth embodiment differs from the fifth embodiment in the structure of a connecting component, and the fundamental configuration of the electronic apparatus is identical with the fifth embodiment.

Figure 13:
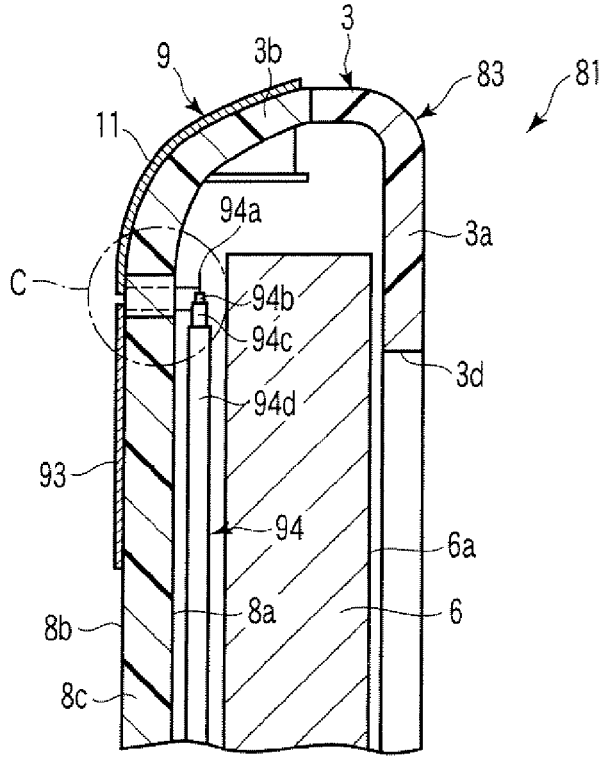
FIG. 13 is an exemplary cross-sectional view of an electronic apparatus according to a sixth embodiment of the present invention.

As shown in FIG. 13, a second conductive layer 93 according to this embodiment is provided on an outer surface 8*b* of a housing 3. The second conductive layer 93 is formed by, for example, in-mold fabrication, metal vapor deposition, plating, or sputtering. The second conductive layer 93 serves as, for example, an antenna ground of an antenna 9. The second conductive layer 93 is an example of another conductive layer mentioned in the present invention.

FIG. 13 is a view schematically showing the connection structure for connecting a coaxial cable 94 and an antenna 9 to each other. As shown in FIG. 13, the coaxial cable 94 is provided inside the housing 3. A signal section 94*a* of the coaxial cable 94 is electrically connected to a first conductive layer 11.

Further, a ground section 94*c* is electrically connected to the second conductive layer 93. In this embodiment, the signal section 94*a* as a first conductive member is an example of a conductive member mentioned in the present invention. Further, the ground section 94*c* as a second conductive member is an example of another conductive member mentioned in the present invention.

Figure 14:
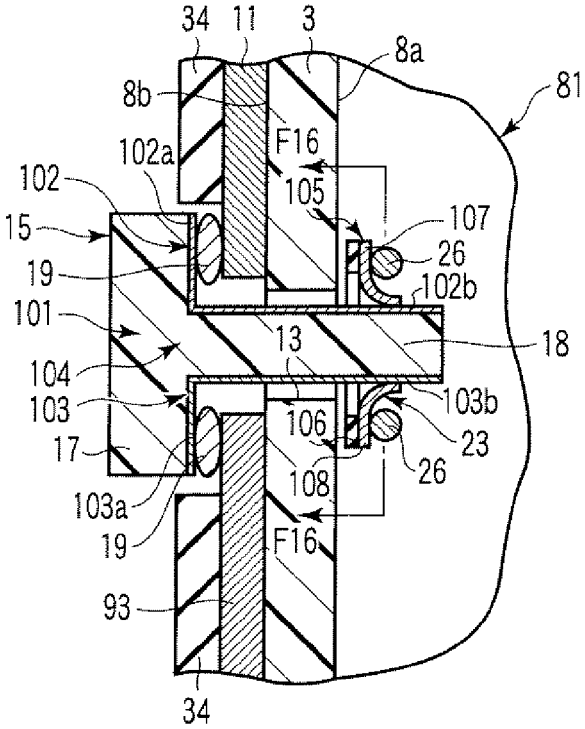
FIG. 14 is an exemplary cross-sectional view of a region of the electronic apparatus shown in FIG. 13 encircled by a one dotted chain line C.
Figure 15:
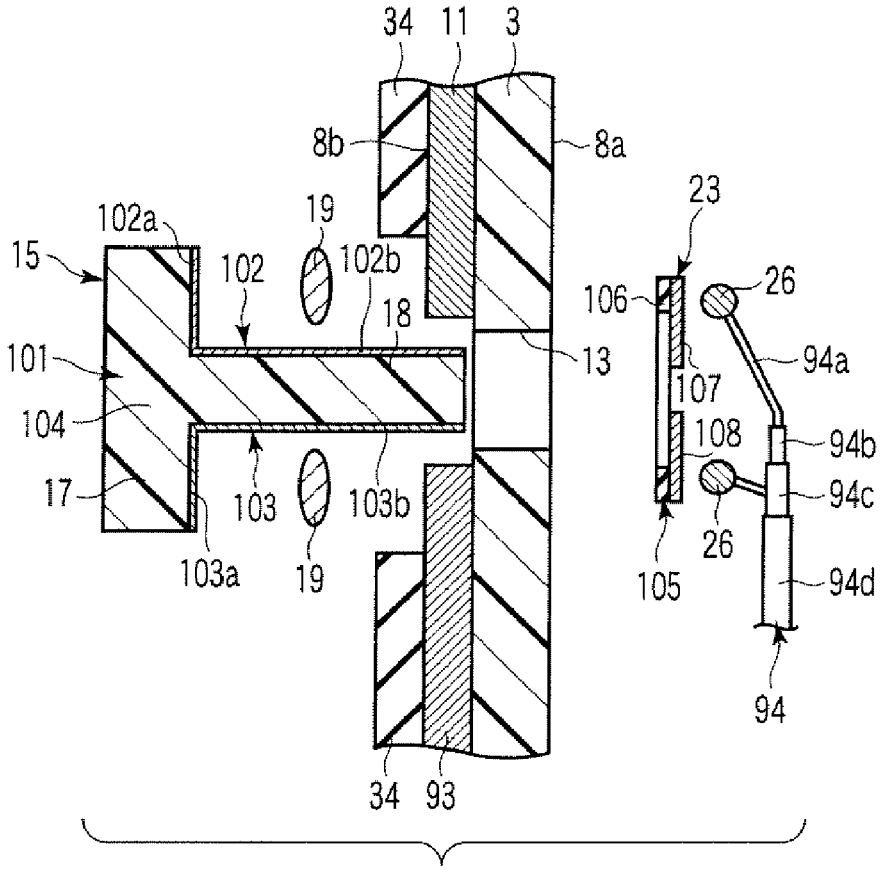
FIG. 15 is an exemplary cross-sectional view showing a connection structure shown in FIG. 14 in an exploded state.

Next, the connection structure for connecting the coaxial cable 94 and the antenna 9 to each other will be shown below in detail with reference to FIGS. 14 to 16. FIG. 14 is a view showing the connection structure for connecting the coaxial cable 94 and the antenna 9 to each other in detail. FIG. 15 is a view showing the connection structure in an exploded state.

As shown in FIGS. 14 and 15, a housing 3 is provided with a through hole 13. The first and second conductive layers 11 and 93 are provided adjacent to the through hole 13. An electronic apparatus 81 is provided with a connecting component 15 which is attached to the housing 3, and electrically connects the first and second conductive layers 11 and 93 to the coaxial cable 94. The connecting component 15 according to this embodiment is a connection pin 101 having conductivity, and also provided with a major diameter section 17 and a minor diameter section 18.

The connection pin 101 is provided with a first conductive section 102 and a second conductive section 103. In an example of the connection pin 101, the first and second conductive sections 102 and 103 are provided on a circumferential surface of a pin main body made of an electrical insulator. That is, an example of the connection pin 101 is one that can be obtained by providing conductive layers on a circumferential surface of the pin main body made of, for example, a synthetic resin material by, for example, plating.

As shown in FIG. 15, the example of the connection pin 101 is provided with the first conductive section 102 provided on a part of a surface of each of a minor diameter section 18 and a major diameter section 17 in the circumferential direction, and the second conductive section 103 provided on another part of the surface of each of the minor diameter section 18 and the major diameter section 17 in the circumferential direction. Each of the first and second conductive sections 102 and 103 is continuously extended from the minor diameter section 18 to the major diameter section 17. The first and second conductive sections 102 and 103 are provided in regions different from each other in the angular position by 180° on the circumferential surface of the connection pin 101. An electrical insulation section 104 is interposed between the first and second conductive sections 102 and 103, and hence the first and second conductive sections 102 and 103 are electrically insulated from each other.

As shown in FIG. 14, a first part 102*a* of the first conductive section 102 formed on the major diameter section 17 is opposed to the first conductive layer 11, and is electrically connected to the first conductive layer 11. A first part 103*a* of the second conductive section 103 formed on the major diameter section 17 is opposed to the second conductive layer 93, and is electrically connected to the second conductive layer 93.

On the other hand, a receiving member 23 according to this embodiment is a ring member 105. As shown in FIGS. 15 and 16, the ring member 105 includes a ring part 106 which is formed into a ring-like shape and has electrical insulating properties, and first and second terminals 107 and 108 each of which is provided at a part of the ring part 106 in the circumferential direction thereof, and extends from the ring part 106 inwardly in the radial direction. The first and second terminals 107 and 108 have conductivity, and are each provided in regions, for example, in the ring part 106 different from each other in the angular position by 180° in the circumferential direction. The first and second terminals 107 and 108 are electrically insulated from each other. As shown in FIG. 16, the signal section 94*a* of the coaxial cable 94 is electrically connected to the first terminal 107. The ground section 94*c* of the coaxial cable 94 is electrically connected to the second terminal 108.

The first and second terminals 107 and 108 are formed of, for example, a spring material, and have elasticity. When the minor diameter section 18 of the connection pin 101 is inserted between the first and second terminals 107 and 108 as shown in FIGS. 14 and 16, the first and second terminals 107 and 108 are elastically deformed to be warped, and the minor diameter section 18 is held between the first and second terminals 107 and 108. In this manner, the minor diameter section 18 of the connection pin 101 inserted in the housing 3 is engaged with the ring member 105. The ring member 105 is formed larger than the through hole 13. Thus, the connection pin 101 engaged with the ring member 105 becomes unable to be pulled out of the through hole 13.

The first terminal 107 of the ring member 105 is brought into contact with the second part 102*b* of the first conductive section 102 formed on the minor diameter section 18, and is electrically connected to the first conductive section 102. The second terminal 108 of the ring member 105 is brought into contact with the second part 103*b* of the second conductive section 103 formed on the minor diameter section 18, and is electrically connected to the second conductive section 103. As a result of this, the first conductive layer 11 is electrically connected to the signal section 94*a* of the coaxial cable 94 through the connection pin 101 and the ring member 105. The second conductive layer 93 is electrically connected to the ground section 94*c* of the coaxial cable 94 through the connection pin 101 and the ring member 105.

According to the electronic apparatus 81 configured as described above, it is possible, as the first and fifth embodiments, to electrically connect the conductive member provided in the housing 3 to the conductive layers 11 and 93 provided on the outer surface 8*b* of the housing 3 at an arbitrary position, and restrict electrical loss caused at the connection section between the conductive members and the conductive layers 11 and 93 to a low level.

The connecting component 15 is provided with the first and second conductive sections 102 and 103 which are electrically separated from each other. When these first and second conductive sections 102 and 103 electrically connect, independently of each other, the conductive layers 11 and 93 to the signal section 94*a* and the ground section 94*c*, respectively, a plurality of electrical connections are realized by one connecting component 15. With such a connecting component 15, it is possible to further compactify the structure of the connection section as compared with the case where a plurality of connecting components are used.

When the connecting component 15 is held between the first and second terminals 107 and 108 of the ring member 105, both the fixation and electrical connection of the connecting component 15 can be realized at the same time. When the first and second terminals 107 and 108 have elasticity, and are pressed against the connecting component 15, the electrical connection between each of the first and second terminals 107 and 108 and the connecting component 15 can be made more reliable.

Next, an electronic apparatus 81 according to a seventh embodiment of the present invention will be described below with reference to FIGS. 17 to 19. Incidentally, a configuration having functions identical with or similar to those of the electronic apparatuses according to the first, fifth, and sixth embodiments is denoted by the same reference symbol, and a description thereof is omitted. The seventh embodiment differs from the fifth embodiment in the structure of a connecting component, and the fundamental configuration of the electronic apparatus is identical with the fifth embodiment.

A connection structure for connecting an axial cable 94 and an antenna 9 to each other will be described below in detail with reference to FIGS. 17 to 19. FIG. 17 is a view showing the connection structure for connecting the axial cable 94 and the antenna 9 to each other in detail. FIG. 18 is a view showing the connection structure in an exploded state.

Figure 17:
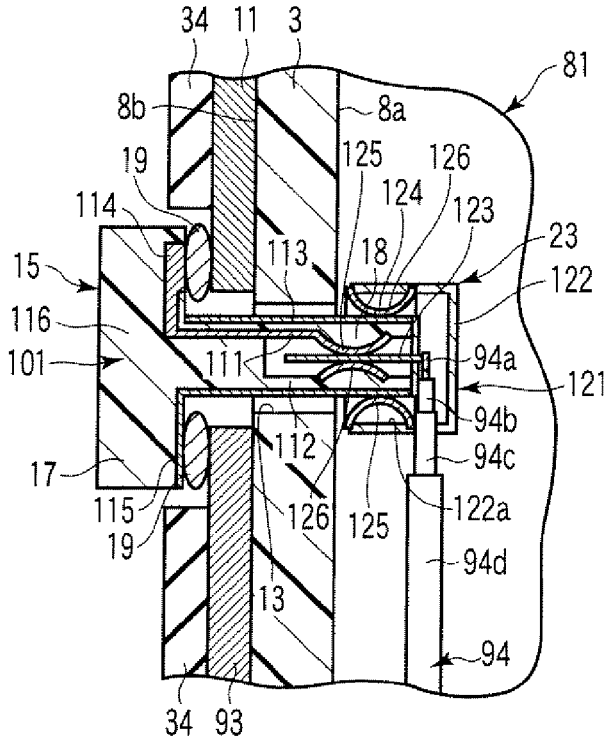
FIG. 17 is an exemplary cross-sectional view of an electronic apparatus according to a seventh embodiment of the present invention.
Figure 18:
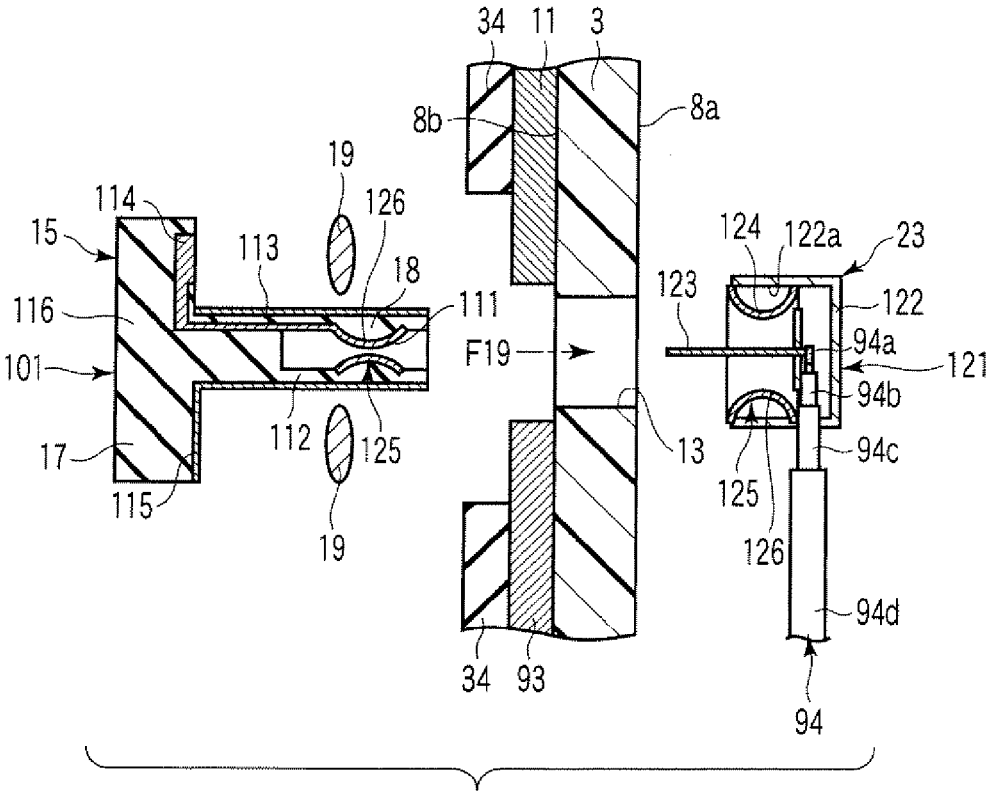
FIG. 18 is an exemplary cross-sectional view showing a connection structure shown in FIG. 17 in an exploded state.
Figure 19:
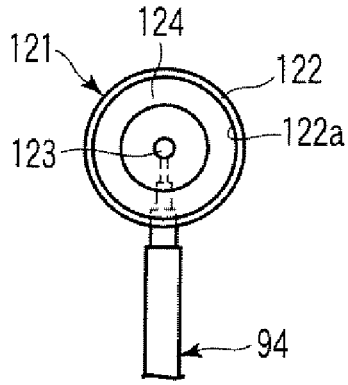
FIG. 19 is an exemplary plan view of a connector shown in FIG. 18 viewed from a direction of an arrow F19.

As shown in FIGS. 17 and 18, a housing 3 is provided with a through hole 13. first and second conductive layers 11 and 93 are provided adjacent to the through hole 13. An electronic apparatus 81 is provided with a connecting component 15 which is attached to the housing 3. The connecting component 15 according to this embodiment is a connection pin 101.

A minor diameter section 18 of the connection pin 101 includes an axis section 111, an intermediate section 112, and a surface section 113 in the order from the axis in the radial direction. The axis section 111 and the surface section 113 have conductivity. The surface section 113 is provided on, for example, the circumference of the minor diameter section 18 all around. That is, the surface section 113 is provided to cover all the peripheral surface of the minor diameter section 18. The intermediate section 112 is an electrical insulator, and electrically insulates the axis section 111 and the surface section 113 from each other.

A major diameter section 17 of the connection pin 101 is provided with a first conductive section 114 electrically connected to the axis section 111, a second conductive section 115 electrically connected to the surface section 113, and an electrical insulation section 116 provided between the first and second conductive sections 114 and 115. The first conductive section 114 is provided on a part of the major diameter section 17 in the circumferential direction, is exposed to the outside of the connection pin 101 at a region opposed to the first conductive layer 11, and is electrically connected to the first conductive layer 11. The second conductive section 115 is provided on a part of a surface of the major diameter section 17 in the circumferential direction, is opposed to the second conductive layer 93, and is electrically connected to the second conductive layer 93.

On the other hand, a receiving member 23 according to this embodiment is a shield connector 121 (hereinafter simply referred to as a connector 121). As shown in FIGS. 18 and 19, the connector 121 includes a connector main body 122 formed into a cup-like shape, and first and second terminals 123 and 124 electrically insulated from each other. The first terminal 123 is provided at the center of the connector 121, and protrudes toward the connection pin 101. The first terminal 123 is electrically connected to a signal section 94*a* which is a conductive member. The second terminal 124 is formed into a ring-like shape, and is provided on an inner circumferential surface 122*a* of the connector main body 122. The second terminal 124 is provided on, for example, an inner circumferential surface 122*a* of the connector main body 122, for example, all around, and encircles a circumference of the first terminal 123. The second terminal 124 is electrically connected to a ground section 94*c* which is another conductive member, and is at the ground potential. The connector main body 122 is electrically connected to, for example, the ground section 94*c*, and is at the ground potential. As a result of this, a shielding structure covering the first terminal 123 from the radial direction and the axial direction is formed.

As shown in FIG. 17, the minor diameter section 18 of the connection pin 101 inserted in the housing 3 is fitted into the connector 121. As a result of this, the first terminal 123 of the connector 121 is brought into contact with the axis section 111 of the connection pin 101, and is electrically connected to the axis section 111. The second terminal 124 of the connector 121 is brought into contact with the surface section 113 of the connection pin 101, and is electrically connected to the surface section 113. As a result of this, the first conductive layer 11 is electrically connected to the signal section 94*a* of the coaxial cable 94 through the connection pin 101 and the connector 121. The second conductive layer 93 is electrically connected to the ground section 94*c* of the coaxial cable 94 through the connection pin 101 and the connector 121.

In this embodiment, for example, each of the axis section 111 of the connection pin 101 and the second terminal 124 of the connector 121 is provided with a spring structure 125 which produces an engaging force between the connection pin 101 and the connector 121. As an example of the spring structure 125, for example, the axis section 111 of the connection pin 101 is provided with a holding section 126 that holds the first terminal 123 of the connector 121 by being elastically deformed. As an example of the spring structure 125, for example, the second terminal 124 of the connector 121 is provided with a holding section 126 that holds the surface section 113 of the connection pin 101 by being elastically deformed.

According to the electronic apparatus 81 configured as described above, it is possible, as the first and fifth embodiments, to electrically connect the conductive members provided in the housing 3 to the conductive layers 11 and 93 provided on the outer surface 8*b* of the housing 3 at an arbitrary position, and restrict electrical loss caused at the connection section between the conductive members and the conductive layers 11 and 93 to a low level. With this connecting component 15, a plurality of electrical connections are realized by one connecting component 15, as in the sixth embodiment. Accordingly, with such a connecting component 15, it is possible to further compactify the structure of the connection section as compared with the case where a plurality of connecting components are used.

In the connection structure according to this embodiment, in the connection pin 101, the circumference of the axis section 111 is surrounded all around by the surface section 113 electrically connected to the ground throughout the full length of the minor diameter section 18, for example, whereby a shielding structure is formed. Further, in the connector 121, the circumference of the first terminal 123 is surrounded by all around the second terminal 124 electrically connected to the ground, whereby the shielding structure is formed. Furthermore, the connection section between the axis section 111 and the first terminal 123 is covered by the connector main body 122 from the axial direction, whereby the connection section between the axis section 111 and the first terminal 123 is not exposed to the outside of the connection structure.

That is, according to such connection pin 101 and connector 121, a shielding structure equivalent to the coaxial cable 94 is continuously realized up to the outside of the housing 3, and hence it is possible to further restrict electrical loss between a printed circuit board 5 and the conductive layers 11 and 93, and obtain an electronic apparatus 81 advantageous from the viewpoint of EMI.

Figure 20:
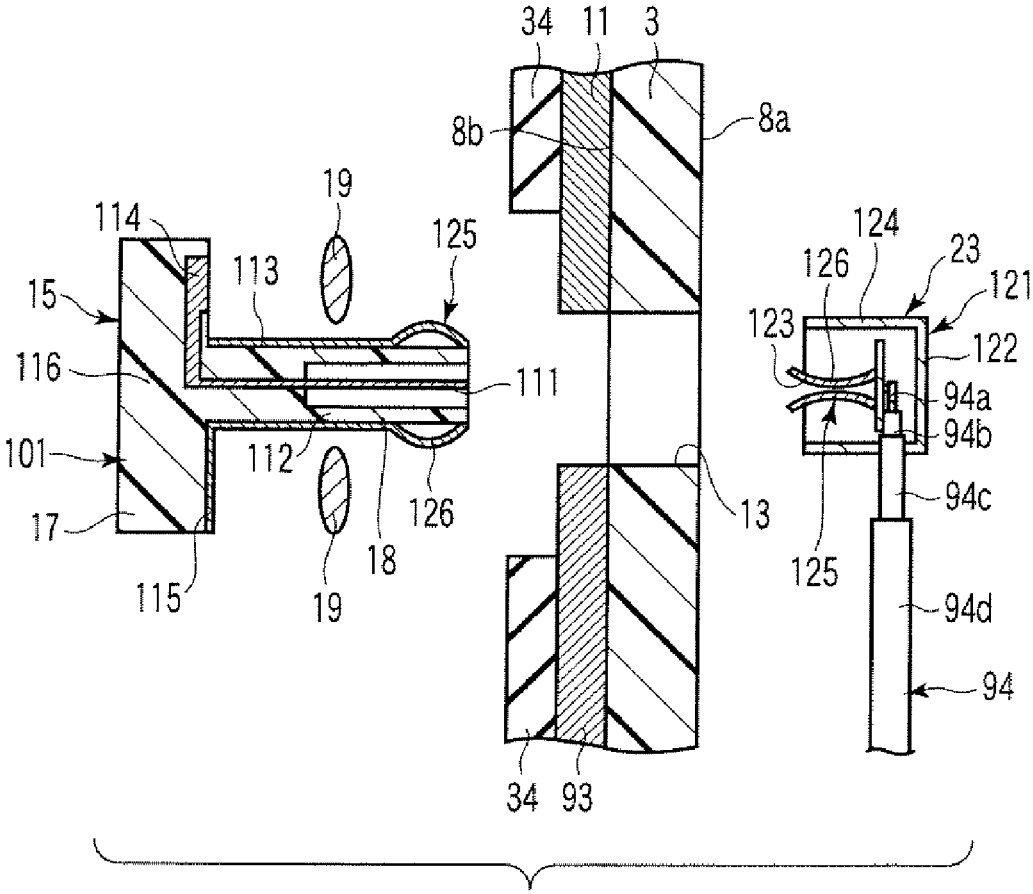
FIG. 20 is an exemplary cross-sectional view of a modification example of the electronic apparatus shown in FIG. 17.

Incidentally, FIG. 20 shows a modification example of the electronic apparatus 81 according to the seventh embodiment of the present invention.

As shown in FIG. 20, in this modification example, each of the surface section 113 of the connection pin 101, and the first terminal 123 of the connector 121 is provided with a spring structure 125 which produces an engaging force between the connection pin 101 and the connector 121. As an example of the spring structure 125, for example, the surface section 113 of the connection pin 101 is provided with a contact section 126 which is brought into contact with the second terminal 124 of the connector 121 by being elastically deformed. For example, the first terminal 123 of the connector 121 is provided with a holding section 126 that holds the axis section 111 of the connection pin 101 by being elastically deformed.

When at least one of the axis section 111 and the surface section 113 of the connecting component 15 described above, and the first terminal 123 and the second terminal 124 of the receiving member 23 is provided with a spring structure 125 which produces an engaging force between the connecting component 15 and the receiving member 23, it is possible to simultaneously realize both the fixation and electrical connection between the connecting component 15 and the receiving member 23.

Furthermore, when one of the axis section 111 of the connecting component 15, and the first terminal 123 of the receiving member 23 which are combined with each other is provided with a spring structure 125, the electrical connection between the connecting component 15 and the receiving member 23 is made more reliable. When one of the surface section 113 of the connecting component 15, and the second terminal 124 of the receiving member 23 which are combined with each other is provided with a spring structure 125, the electrical connection between the connecting component 15 and the receiving member 23 is made more reliable.

The electronic apparatuses 1 and 81 according to the first to seventh embodiments have been described above. However, the present invention is not limited to these. Constituent elements according to the embodiments may be appropriately combined with each other to be employed.

For example, the conductive member mentioned in the present invention is not limited to the printed circuit board and the coaxial cable. For example, the other feeder lines provided in the housing or conductive members provided for various purposes may be the conductive member. The first and second conductive layers 11 and 93 are not limited to the antenna element and the ground.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An electronic apparatus comprising:

a housing comprising a through hole;

a conductive layer provided on an outer surface of the housing;

a conductive member provided inside the housing;

a connecting component attached to the housing, the connecting component having conductivity, and the connecting component comprising (i) a major diameter section opposed to the conductive layer from outside the housing and the major diameter section electrically connected to the conductive layer, and (ii) a minor diameter section inserted in the through hole to reach the inside of the housing;

a receiving member provided inside the housing, the receiving member having conductivity, and the receiving member being engaged with the minor diameter section; and an elastic connecting component having conductivity, and the elastic connecting component being interposed between the receiving member and the conductive member, the elastic connecting component comprising an elastic part at least in a part of the elastic connecting component, the elastic part being compressed between the receiving member and the conductive member, and the elastic part electrically connecting the connecting component to the conductive member via the receiving member.

2. The electronic apparatus of claim 1, wherein the connecting component is a screw, and the conductive member is a printed circuit board.

3. The electronic apparatus of claim 1, wherein the through hole allows the inside of the housing to communicate with the outside.

4. The electronic apparatus of claim 3, wherein the major diameter section is larger than the through hole.

5. The electronic apparatus of claim 4, wherein the receiving member is larger than the through hole.

6. An electronic apparatus comprising:

a housing comprising a through hole;

a first conductive layer provided on an outer surface of the housing;

a second conductive layer provided on the outer surface of the housing;

a first conductive member provided inside the housing;

a second conductive member provided inside the housing; and a connecting component attached to the housing, and the connecting component comprising (i) a major diameter section opposed to the first conductive layer and the second conductive layer from outside the housing, (ii) a minor diameter section inserted in the through hole to reach the inside of the housing, (iii) a first conductive section electrically connecting the first conductive layer to the first conductive member, and (iv) a second conductive section electrically connecting the second conductive layer to the second conductive member.

7. The electronic apparatus of claim 6, wherein the first conductive section is provided on a part of a surface of each of the minor diameter section and the major diameter section in the circumferential direction, and the second conductive section is provided on another part of the surface of each of the minor diameter section and the major diameter section in the circumferential direction.

8. The electronic apparatus of claim 6, wherein the connecting component comprises an electrical insulation section provided between the first conductive section and the second conductive section.

9. The electronic apparatus of claim 6, further comprising a receiving member being provided inside the housing, and the receiving member being engaged with the minor diameter section, the receiving member comprising a first terminal through which the first conductive section is electrically connected to the first conductive member, and a second terminal thorough which the second conductive section is electrically connected to the second conductive member.

10. The electronic apparatus of claim 6, wherein the through hole allows the inside of the housing to communicate with the outside.

11. The electronic apparatus of claim 6, wherein the major diameter section is larger than the through hole.

12. The electronic apparatus of claim 6, wherein the connecting component further comprises an axis section and a surface section in the minor diameter section, the axis section being electrically connected to the first conductive member, the surface section being electrically connected to the second conductive member, the first conductive section is in the major diameter section, the first conductive section electrically connecting the first conductive layer to the axis section, and the second conductive section is in the major diameter section, the second conductive section electrically connecting the second conductive layer to the surface section.

13. The electronic apparatus of claim 12, wherein the minor diameter section comprises an intermediate section, the intermediate section being an insulator for electrically insulating the axis section and the surface section from each other, and the major diameter section comprises an electrical insulation section being provided between the first conductive section and the second conductive section.

14. The electronic apparatus of claim 12, further comprising a receiving member being provided inside the housing, and the receiving member being engaged with the minor diameter section, the receiving member comprising a first terminal through which the axis section is electrically connected to the first conductive member, and a second terminal through which the surface section is electrically connected to the second conductive member.

15. The electronic apparatus of claim 14, wherein the second terminal is formed into a ring-like shape, encircles a circumference of the first terminal, and is electrically connected to a ground, and the surface section is provided on a circumference of the minor diameter section, and is electrically connected to the ground.

16. The electronic apparatus of claim 14, wherein at least one of the axis section and the surface section of the connecting component, and at least one of the first terminal and the second terminal of the receiving member is provided with a spring structure which produces an engaging force between the connecting component and the receiving member.

17. The electronic apparatus of claim 14, wherein the receiving member is larger than the through hole.

* * * * *